US005416292A

United States Patent [19]

Behnke et al.

[11] Patent Number: 5,416,292

[45] Date of Patent: May 16, 1995

[54] IGNITION DISTRIBUTOR FOR INTERNAL COMBUSTION ENGINES

[75] Inventors: Horst Behnke, Esslingen; Roland Michal, Pforzheim; Klaus Bahm, Kraichtal, all of Germany

[73] Assignees: Doduco GmbH and Co.; Eugen Dürrwächter, Pforzheim, Germany

[21] Appl. No.: 835,996

[22] PCT Filed: Aug. 22, 1990

[86] PCT No.: PCT/EP90/01395

§ 371 Date: Apr. 8, 1993

§ 102(e) Date: Apr. 8, 1993

[87] PCT Pub. No.: WO91/02899

PCT Pub. Date: Mar. 7, 1991

[30] Foreign Application Priority Data

Aug. 22, 1989 [DE] Germany ..... 8910037 U

[51] Int. Cl.[6] ..... H01H 19/00; F02D 7/02

[52] U.S. Cl. ..... 200/19 R; 200/19 DR

[58] Field of Search ..... 200/19 R, 19 DC, 19 DR, 200/27 R, 27 A, 30 R, 30 A, 31 DP

[56] References Cited

U.S. PATENT DOCUMENTS

| | | | |
|---|---|---|---|
| 3,542,976 | 11/1970 | Moray | 200/24 |
| 4,281,627 | 8/1981 | Sakurai | 123/146.5 A |
| 4,308,436 | 12/1981 | Sone et al. | 200/19 R |
| 4,393,282 | 7/1983 | Grünwald et al. | 200/19 R |
| 4,470,385 | 9/1984 | Burk et al. | 123/146.5 B |
| 4,475,491 | 10/1984 | Grünwald et al. | 123/146.5 A |
| 4,538,564 | 9/1985 | Ehrmann et al. | 123/146.5 A |
| 4,661,661 | 4/1987 | Kronberger | 200/19 R |
| 5,053,587 | 10/1991 | Betz | 200/19 R |

FOREIGN PATENT DOCUMENTS

| | | | |
|---|---|---|---|
| 502536 | 5/1920 | France . | |
| 525168 | 9/1921 | France . | |
| 2039754 | 1/1971 | France | F02P 7/00 |
| 2133120 | 11/1972 | France | F02P 7/00 |
| 3136745 | 3/1983 | Germany | H01R 39/60 |
| 3837808 | 11/1988 | Germany | F02P 7/03 |

*Primary Examiner*—A. D. Pellinen
*Assistant Examiner*—Michael A. Friedhofer
*Attorney, Agent, or Firm*—Dvorak and Traub

[57] ABSTRACT

The ignition distributor comprises a housing, in which a distributor rotor (4) is rotatably mounted, which comprises a first electrode (9) close to the axis of rotation (5) of the rotor, a second electrode (10) at that end of the rotor which is remote from the axis of rotation, and between said electrodes an electrical line (11), which connects the two electrodes. The housing is closed by a distributor cap (1), which is provided on its inside surface with a plurality of peripherally spaced apart stationary electrodes ( 3 ), which cooperate with the second electrode (10) of the distributor rotor, and also comprises a center electrode (2), which terminates at a small distance from and defines a spark gap with the first electrode (9) of the distributor rotor. One electrode of the pair consisting of the first electrode (9) of the distributor rotor and the center electrode (2) is pinlike and the other electrode (9) does not surround the pinlike electrode (2) or surrounds it around less than its entire periphery.

30 Claims, 2 Drawing Sheets

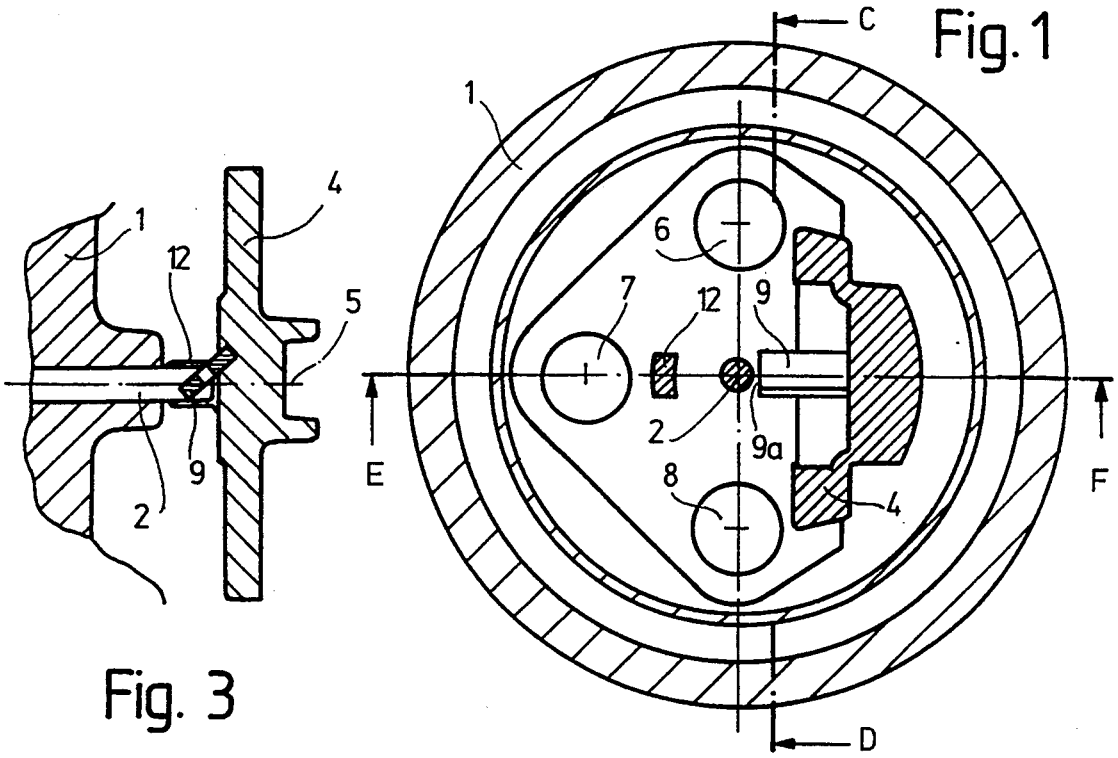
Fig. 1
Fig. 3
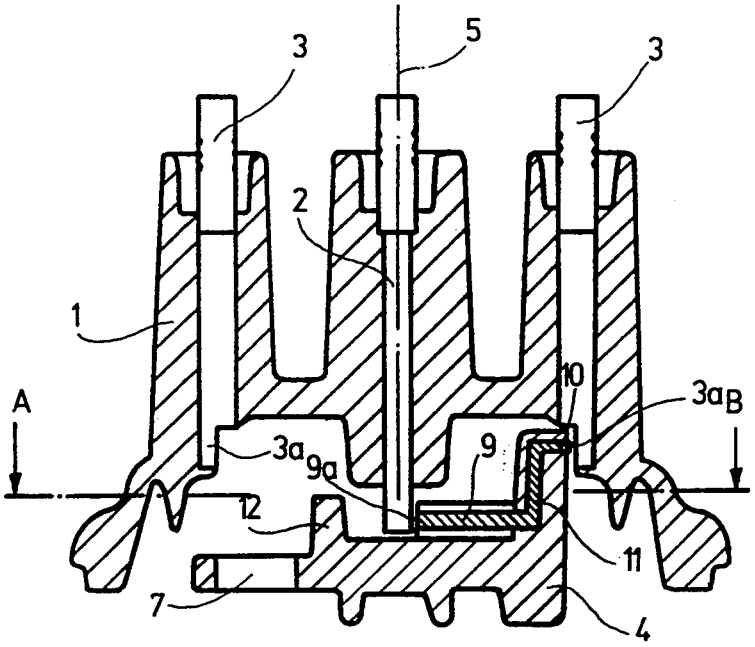
Fig. 2

Fig. 5
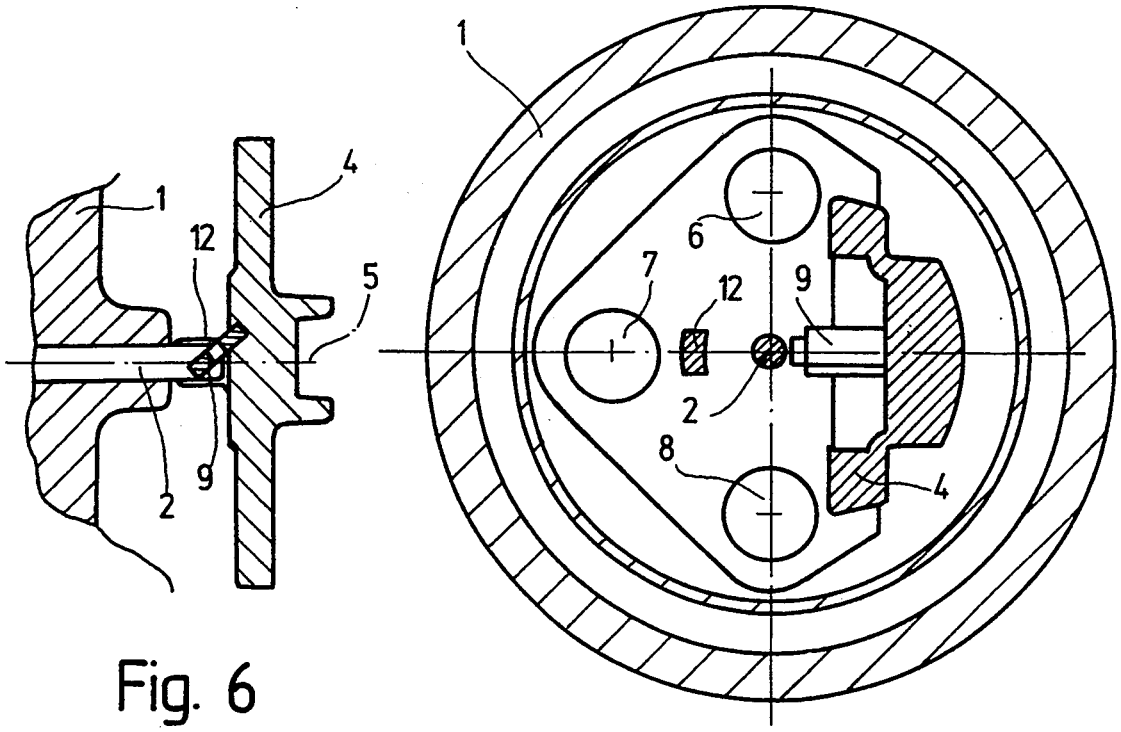
Fig. 6
Fig. 4
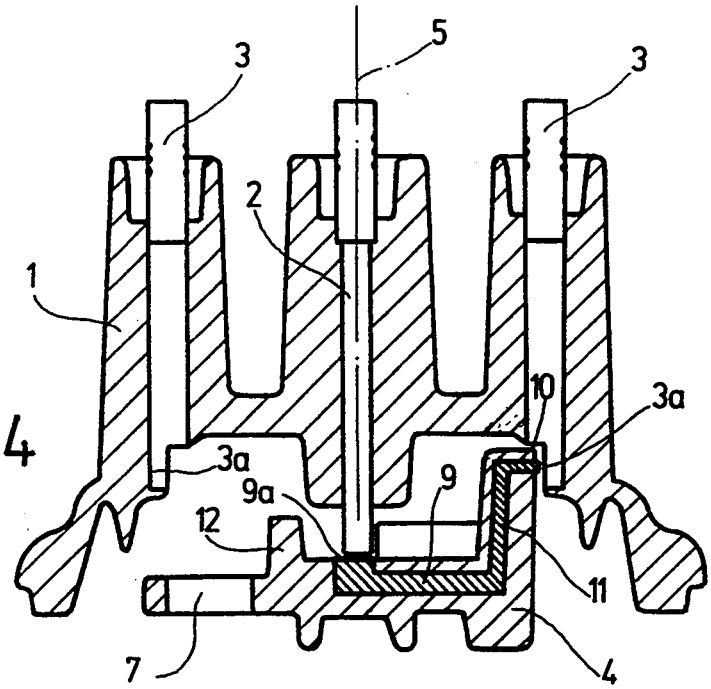

IGNITION DISTRIBUTOR FOR INTERNAL COMBUSTION ENGINES

This invention relates to an ignition distributor for internal combustion engines comprising a housing, in which a distributor rotor is rotatably mounted, which comprises a first electrode close to the axis of rotation of the rotor, a second electrode at that end of the rotor which is remote from its axis of rotation, and between said electrodes an electrical line connecting the electrodes, and a distributor cap, which closes the housing and is provided on its inside surface with a plurality of peripherally spaced apart stationary electrodes, which cooperate with the second electrode of the distributor rotor, and comprises a center electrode, which is closely spaced from and defines a spark gap with the first electrode of the distributor rotor, wherein one electrode of the pair consisting of the first electrode of the distributor rotor and the center electrode is pinlike.

PRIOR ART

Such an ignition distributor is known from DE-37 43 940 A1. In the known ignition distributor the first electrode of the distributor rotor defines a spark gap with the center electrode of the distributor cap and consists of a bushing, into which the pinlike center electrode protrudes. As is usual with spark gaps, the two electrodes consist of brass. To cause the spark discharge to occur under an arc voltage which is as low as possible, it is desired to minimize the effective distance between the two electrodes; that distance is typically 0.5 mm and should not exceed 1 mm.

Whereas the electrodes defining the arc gap are not subjected to mechanical wear, as are the otherwise usual sliding contacts between the distributor rotor and the center electrode of the distributor cap, the life of the electrodes defining the arc gap has not been satisfactory thus far.

SUMMARY OF THE INVENTION

It is an object of the present invention to provide an ignition distributor which is of the kind described first hereinbefore and in which the pair of electrodes comprising the center electrode of the distributor cap has a longer life.

That object is accomplished by an ignition distributor having the features stated in claim 1. Desirable further features of the invention are subject matters of the dependent claims.

In the search for the solution provided by the invention it has been found that a cause of the wear of the pair of center electrodes resides in that the two electrodes are not exactly coaxial to one another. As a result, the pinlike center electrode of the distributor cap is irregularly consumed around its periphery because the spark discharge takes place preferentially at the narrowest portion of the annular gap between the center electrode and the bushinglike electrode of the distributor rotor. Whereas it would be obvious to accomplish the object by measures by which the deviations from an exactly coaxial arrangement would be decreased, that approach has not been successful because it has been found, in the first place, that the observed deviations from an exactly coaxial arrangement are virtually inevitable owing to the design and arrangement of the ignition distributor and, in the second place, that even when the coaxial arrangement of the two electrodes is improved the wear of the electrodes will still be excessive and will result in an insufficient life. The inventors have then found that the wear of the electrodes is not only due to spark erosion but the electrode surface is also chemically attacked. There are believed to be different causes of the chemical attack. In the first place the spark discharge and the accompanying conversion of energy will result in an excitation of the ambient gas atmosphere and it is believed that this results in a formation of ozone and nitrogen oxides. Besides, the electrodes and the plastic surrounding them are subjected to considerable thermal stresses caused by the spark discharges so that components of the plastic are decomposed and released. These components comprise also chlorine-containing components of flame-retardant substances. It is believed that an aggressive gas mixture is formed, which acts on the electrode surfaces and substantially contributes to their wear.

The design of the ignition distributor in accordance with the invention produces two results: Because the electrode which cooperates with the pinlike electrode does not consist as in the prior art of a bushing by which the pinlike electrode is surrounded all around its periphery, but consists of an electrode by which the pinlike electrode is not surrounded or is surrounded around less than its entire periphery, the spark cannot always impinge on the pinlike electrode at the same point even when the arrangement is not coaxial but the spark must necessarily migrate and the consumption will be the more uniform the smaller is the angle in which the pinlike electrode is surrounded by the other electrode. For this reason the pinlike electrode is preferably surrounded by the other electrode around less than one-half of its periphery. Besides, the aggressive gases which are produced in association with the spark discharge can more easily escape from the region of the two electrodes if the pinlike electrode is no longer surrounded by a closed bushing, as is the case in the prior art. In a particularly desirable arrangement that other electrode which together with the pinlike electrode defines the spark gap has a substantially planar surface facing the pinlike electrode because this will result in a particularly uniform consumption of the pinlike electrode and in that case the aggressive gases can particularly easily escape from the region of the electrodes and, if the pinlike electrode is the center electrode of the distributor cap, that escape will be promoted by the fact that the other electrode, which rotates with the distributor rotor, will impart to the air a motion, by which the escape of the aggressive gases from the region of the electrodes will be promoted, particularly if the planar surface of the rotating electrode is inclined from or skewed relative to the longitudinal axis of the pinlike electrode.

On principle the invention may be implemented in such a manner that the pinlike electrode is either the center electrode of the distributor cap or the first electrode of the distributor rotor. The first alternative is preferred because it permits a better ventilation of the region of the electrode than an arrangement in which the pinlike electrode is provided on the distributor rotor. For an improved ventilation it will be desirable no longer to recess the first electrode of the distributor rotor, as was previously the case, but to cause said first electrode to protrude from the body of the distributor rotor into the space between the distributor rotor and the distributor cap. The distributor rotor preferably has an extension, which also protrudes into said space and which like a fan blade effects an additional circulation of air. The first electrode of the distributor rotor may consist of a part of that air-circulating extension or may be separate from said extension and, for instance, may be diametrically opposite to it with respect to the axis of rotation.

If the pinlike electrode is surrounded in part by the other electrode the ventilation of the region of the electrodes may be promoted in that the surrounding electrode is perforate. The ventilation of the region of the electrode can also be improved in that the distributor rotor is formed adjacent to the pinlike electrode with a through hole (see FIG. 6), which is suitably opposite to the pinlike center electrode of the distributor cap but need not extend in the direction of the axis of rotation but is preferably oblique to the axis of rotation so that a pumping action will be produced.

An effective ventilation of the electrode region can also be effected in that the pinlike electrode and the other electrode are not disposed one beside the other but are opposite to each other so that the spark is discharged from the tip of the pinlike electrode to the opposite electrode, which preferably has a planar surface, which faces the pinlike electrode and which is larger than the cross-sectional surface of the pinlike electrode so that deviations from an exactly coaxial arrangement will not adversely affect the function of the arc gap. (See FIG. 4).

The ventilation of the arc gap can also be improved in that the first electrode of the distributor rotor is provided on that side which faces the pinlike center electrode of the distributor cap with a projection which acts like a fan blade and preferably consists of a rib that is parallel to the pinlike electrode (see FIG. 5). A Still longer life will be achieved if that projection consists of a material having a higher wear resistance than the electrode outside the region of the projection. Outside the region of the projection, where the electrode will not be subjected to a spark discharge, the electrode may consist of an easily workable material of high electrical conductivity, such as copper or brass, and the projection having a higher wear resistance may be welded to said easily workable material. Electrodes having a higher wear resistance can be provided by a proper selection of materials in various ways. In one case the electrode may be made of or provided with a material which is nobler than copper. Particularly suitable materials are those which contain at least 20% by weight silver or at least 10% by weight palladium, particularly silver-nickel composite materials or palladium-copper alloys. Particularly suitable materials consist of silver with 10 to 40% by weight, preferably 30% by weight, nickel or of palladium with 10 to 30% by weight, preferably 15% by weight, copper. Whereas such materials are known per se for use as electric contacts, they are not usually employed as materials for electrodes which define spark gaps. Owing to their noble metal content they have a higher resistance to the chemical attack of the aggressive gases which are produced by the spark discharge.

Another desirable measure by which the chemical stability of the electrodes can be increased is to make them from or to provide them with materials which tend to form a passivating cover layer. Materials which are particularly suitable from this aspect belong to the group of the alloys of copper with nickel and suitably have a nickel content between 10 and 40% by weight, preferably about 30% by weight; the chemical stability can be still further improved by an incorporation of a small amount (1 to 2% by weight) of iron in the alloy. The electrodes may also comprise materials of chromium-alloyed steels because they will form a passivating cover layer of chromium oxide for protection against the attack of the aggressive gases. Such materials which tend to form a passivating cover layer are also not usually employed in electrodes which define arc gaps.

The life of the electrodes can also be improved in that the electrode material is provided with small amounts of a substance, such as thorium oxide, by which the electron work function is decreased. Electrodes having a lower electron work function require a lower arc voltage for the spark discharge so that the spark discharge involves a lower conversion of energy. As a result, the electrical losses in the ignition distributors will be decreased and less reactive gases will be produced.

BRIEF DESCRIPTION OF THE DRAWINGS

An illustrative embodiment of the invention is schematically shown in the accompanying drawings.

FIG. 1 is a transverse sectional view showing an ignition distributor viewed on section line A–B in FIG. 2, which extends through the distributor rotor at right angles to its axis of rotation.

FIG. 2 is a longitudinal sectional view taken on line E–F in FIG. 1, which extends through the axis of rotation of the distributor rotor, and shows the arrangement of the distributor cap and distributor rotor relative to each other.

FIG. 3 is another longitudinal sectional view taken on line C–D in FIG. 1 in a direction which is offset 90° from the direction of view of FIG. 2 and also shows the assembly comprising the distributor cap and the distributor rotor.

FIG. 4 is an alternative embodiment of FIG. 2 showing an electrode opposite to the center electrode, and larger in diameter than the center electrode.

FIG. 5 is an alternative embodiment of FIG. 1 showing an electrode with a projection thereon.

FIG. 6 is an alternative embodiment of FIG. 3 showing a perforated electrode.

DETAIL DESCRIPTION OF THE INVENTION

The housing of the ignition distributor is represented only by the distributor cap 1, which comprises a pinlike center electrode 2 and is provided at its periphery with a plurality of stationary electrodes 3, which are parallel to the center electrode 2 and spaced around the periphery of the cap 1 and on the inside of the distributor cap have electrode faces 3*a*, which face the center electrode 2.

The ignition distributor contains a distributor rotor 4, which is rotatable about an axis 5, which is coaxial to the center electrode 2. The flat body of the distributor rotor has three bores 6, 7, and 8 for the fixation of the distributor rotor at the end of the camshaft of an internal combustion engine, the housing (engine block) of which constitutes one-half of the housing of the ignition distributor whereas the other half of said housing is constituted by the distributor cap 1. The distributor rotor carries two electrodes. An elongate first electrode 9 is provided on the top surface of the body of the distributor rotor 4 and extends radially and terminates at a small distance of about 0.5 mm from the peripheral surface of the cylindrical center electrode 2 of the distributor cap. At a radially outwardly disposed location the distributor rotor carries a second electrode 10, which has a radially outwardly facing surface, which during a rotation of the distributor rotor moves past the surfaces 3*a* of the stationary electrodes 3 at a small distance therefrom. The electrodes 9 and 10 are interconnected by an electric line 11, which is embedded in the distributor rotor.

As is best shown in FIG. 3 the first electrode 9 of the distributor rotor, which electrode cooperates with the center electrode 2, is a parallel-epipedic electrode, which has a planar end face 9*a* facing the center electrode 2. The normals on the radially extending surfaces of the electrode 9 include an angle of about 45° with the axis 5 of the distributor rotor 4.

Owing to that orientation the electrode 9 acts like a fan blade, which effects a circulation of air in the space between the distributor rotor 4 and the distributor cap 1. The circulation of air is intensified by an extension 12, which is provided on the distributor rotor and is diametrically opposite to the electrode 9. The circulation of air results in a continuous exchange of air in the region of the arc gap which is defined by the center electrode 2 and the first electrode 9 of the distributor rotor and that exchange of air will remove the aggressive gases which accompany the spark discharge so that such gases cannot chemically attack the electrodes 9 and 2. Besides, the center electrode 2 will not be acted upon unilaterally but will uniformly be consumed because the first electrode 9 of the distributor rotor is disposed on one side of the center electrode 2 and is moved around the latter.

INDUSTRIAL UTILITY

The invention is applicable in the automotive trade (manufacturers, suppliers, spare parts business).

We claim:

1. An ignition distributor for internal combustion engines, the distributor comprising:

a housing, in which a distributor rotor is rotatably mounted, the rotor having a first electrode close to the axis of rotation of the rotor, a second electrode at an end of the rotor which is remote from the rotor's axis of rotation, and between said electrodes an electrical line connecting the electrodes, and a distributor cap which closes the housing, the distributor cap provided on its inside surface with a plurality of peripherally spaced apart stationary electrodes engagable with the second electrode of the distributor rotor, the cap having a center electrode with an outer periphery spaced from the first electrode of the distributor rotor and defining a spark gap between the first electrode and the center electrode, wherein the first electrode and the center electrode form a pair of electrodes (2,9) one of which is pinlike, wherein the first electrode (9) is adjacent to not more than a portion of the periphery of the center electrode at any given time to prevent irregular consumption of the center electrode.

2. An ignition distributor according to claim 1, characterized in that the other electrode (9) of the pair of electrodes (2,9) surrounds the pinlike electrode (2) around less than one-half of its periphery.

3. An ignition distributor according to claim 2, characterized in that said other electrode (9) has a substantially planar surface (9*a*) facing the pinlike electrode (2).

4. An ignition distributor according to claim 3, characterized in that the normal on the planar surface (9*a*) is inclined toward the longitudinal axis (5) of the pinlike electrode (2).

5. An ignition distributor according to claim 3, characterized in that the other electrode has a projection on the side which faces the pinlike electrode.

6. An ignition distributor according to claim 5, characterized in that the projection is a rib that extends parallel to the pinlike electrode (2).

7. An ignition distributor according to claim 6, characterized in that the projection consists of a material which has a higher wear resistance than the remainder of the electrode in the region outside the projection.

8. An ignition distributor according to claim 1, characterized in that the other electrode is opposite to the tip of the pinlike electrode (2).

9. An ignition distributor according to claim 8, characterized in that the other electrode is also pinlike.

10. An ignition distributor according to claim 9, characterized in that the two pinlike electrodes differ in diameter.

11. An ignition distributor according to claim 8, characterized in that said other electrode has a substantially planar surface facing the pin-like electrode.

12. An ignition distributor according to claim 1, characterized in that the first electrode (9) of the distributor rotor (2) protrudes from the body of the distributor rotor (4) into the space between the distributor rotor (4) and the distributor cap (1).

13. An ignition distributor according to claim 1, characterized in that the distributor rotor (4) comprises a projection (12), which is eccentric to the axis of rotation (5) of the rotor and protrudes from the body of the rotor into the space between the distributor rotor (4) and the distributor cap (1) and is electrically insulated from the first electrode (9).

14. An ignition distributor according to claim 1, characterized in that the pinlike electrode (2) is the center electrode.

15. An ignition distributor according to claim 14, characterized in that the first electrode (9) has a through hole, which is opposite to the pinlike electrode.

16. An ignition distributor according to claim 1, characterized in that the other electrode is perforate.

17. An ignition distributor according to claim 1, characterized in that at least one electrode of the pair of electrodes (2,9) is provided with a material which is more noble than copper.

18. An ignition distributor according to claim 17, characterized in that the material is selected from the group consisting of the composite materials and alloys with at least 20% by weight silver.

19. An ignition distributor according to claim 18, characterized in that the material consists of silver with nickel.

20. An ignition distributor according to claim 19, characterized in that the material consists of 90 to 60 wt-% silver with 10 to 40% by weight nickel.

21. An ignition distributor according to claim 17, characterized in that the material contains up to 5% by weight of a substance which decreases the electron work function.

22. An ignition distributor according to claim 17, in which the material is selected from the group consisting of the composite materials and alloys with at least 10 wt-% of palladium.

23. An ignition distributor according to claim 22, in which the material consists of palladium with copper.

24. An ignition distributor according to claim 23, in which the material consists of 90 to 70 wt-% of palladium with 10 to 30 wt-% of copper.

25. An ignition distributor according to claim 1, characterized in that at least one electrode of the pair of electrodes (2,9) is provided with a material which tends to form a passivating cover layer thereon.

26. An ignition distributor according to claim 25, characterized in that the material is selected from the group consisting of the alloys of copper with nickel and the chromium-alloy steels.

27. An ignition distributor according to claim 26, characterized in that the material is an alloy of 90 to 60 wt-% copper with 10 to 40% by weight nickel.

28. An ignition distributor according to claim 27, characterized in that the material contains up to 2% by weight iron.

29. An ignition distributor according to claim 27, characterized in that a component which provides chemical stability and a component which increases the resistance to the wear by spark erosion are combined in the material.

30. An ignition distributor according to claim 25, characterized in that the material contains up to 5% by weight of a substance which decreases the electron work function.

* * * * *